US008146784B1

(12) United States Patent
Calanca et al.

(10) Patent No.: US 8,146,784 B1
(45) Date of Patent: Apr. 3, 2012

(54) GARMENT DISPLAY DEVICE

(75) Inventors: Patricia D. Calanca, New Canaan, CT (US); Paul L. Aston, Santee, CA (US)

(73) Assignee: Patricia D. Calanca, New Canaan, CT (US)

( * ) Notice: Subject to any disclaimer, the term of this patent is extended or adjusted under 35 U.S.C. 154(b) by 0 days.

(21) Appl. No.: 13/251,599

(22) Filed: Oct. 3, 2011

Related U.S. Application Data

(63) Continuation of application No. 13/114,870, filed on May 24, 2011.

(51) Int. Cl.
*A41D 27/22* (2006.01)

(52) U.S. Cl. ..... 223/94; 211/85.3

(58) Field of Classification Search ..... 223/89, 223/58, 94; 211/85.3; 59/78, 80, 84
See application file for complete search history.

(56) References Cited

U.S. PATENT DOCUMENTS

| | | | | | |
|---|---|---|---|---|---|
| 1,193,357 | A | | 8/1916 | Buxton | |
| 1,570,196 | A | * | 1/1926 | Barron | 223/89 |
| 2,589,914 | A | * | 3/1952 | Wolf | 30/384 |
| 2,707,070 | A | | 4/1955 | Tanzer | |
| 3,219,241 | A | * | 11/1965 | Newton | 223/94 |
| 3,430,827 | A | * | 3/1969 | Nelson | 223/89 |
| 3,680,927 | A | * | 8/1972 | Neureuther | 305/50 |
| 3,792,776 | A | | 2/1974 | Kenison | |
| 3,834,598 | A | | 9/1974 | Matsumoto | |
| 4,627,544 | A | | 12/1986 | Scarpa et al. | |
| D309,834 | S | * | 8/1990 | Passini | D6/318 |
| 5,022,570 | A | | 6/1991 | Watford | |
| 5,044,534 | A | | 9/1991 | Hwang | |
| 5,503,497 | A | * | 4/1996 | Dudley et al. | 403/103 |
| 5,893,493 | A | | 4/1999 | Noiray | |
| 6,065,653 | A | | 5/2000 | Lin | |
| 6,073,819 | A | | 6/2000 | Wing | |
| 6,170,721 | B1 | | 1/2001 | Chen | |
| 6,223,393 | B1 | * | 5/2001 | Knopf | 16/366 |
| 6,328,186 | B1 | | 12/2001 | Wing | |
| 7,243,823 | B2 | | 7/2007 | Cresap et al. | |
| 7,740,215 | B2 | | 6/2010 | Lang | |

* cited by examiner

*Primary Examiner* — Korie Chan
(74) *Attorney, Agent, or Firm* — St. Onge Steward Johnston & Reens LLC

(57) ABSTRACT

A garment display device has first and second support arms connected to a base and operable to support a portion of a garment. Each support arm has a plurality of links interconnected by link pivot joints which provide for relative angular movement between adjoined links parallel to a common plane. Each link has a socket and a disk and has a flange disposed between the socket and disk for supporting a portion of the garment spanning between adjacent links. The flange overlaps a free end of the socket of the adjoining link to provide a smooth and aesthetic support for the garment over a range of positions of the support arm.

11 Claims, 12 Drawing Sheets

GARMENT DISPLAY DEVICE

CROSS-REFERENCE TO RELATED APPLICATIONS

This application is a continuation of U.S. patent application Ser. No. 13/114,870, filed May 24, 2011, which application is currently pending and which application is hereby incorporated by reference herein in its entirety.

FIELD OF THE INVENTION

The apparatus described herein generally relates to the field of garment displays, and more specifically, to the field of adjustable garment display devices.

BACKGROUND OF THE INVENTION

Clothing of high aesthetic or collector value is often put on public display for decorative or exhibition purposes. Several devices can be used to display clothing. Since the size, weight, and shape of clothing varies greatly, the various display solutions have varying applicability for any given garment.

For example, for certain styles of clothing, a mannequin is a suitable display device. Mannequins are especially suitable where the worn shape of the garment is of primary aesthetic importance. This is often the case for highly elaborate garments or garments that are on a sale display for potential wearers. However, mannequins are typically located on a floor, shelf, or podium and take up significant space on whatever surface they are placed.

Sometimes, the worn shape of a garment is of little importance compared to the colors, fabric, and writing on the garment. For example, athletic jerseys convey almost all of their virtues as aesthetic and collectable pieces when displayed in a flat hanging orientation. This orientation allows a viewer to immediately appreciate the athletic team and athlete associated with the jersey, as well as the attractive coloration and fabric of the jersey. The flat, hanging orientation is also an appealing display option because it takes up no floor space.

Several solutions exist for hanging garments from walls or ceilings. One solution is clothes hangers designed for storage. These have several drawbacks. Firstly, they are often too narrow to display all of the important information on the jersey or garment. The narrowness also detracts from the aesthetic quality of the display position because it creates folds at the edges of the hanger. Furthermore, some storage hangers have a curved profile, which also results in an unappealing hanging orientation. The size and shape of storage hangers are also not adjustable, so they cannot be adjusted to ideally conform to the garment they are hanging. Finally, the storage hangers themselves are usually not aesthetically pleasing which detracts from the appearance and overall impression of the garment display.

More sophisticated solutions include devices that are shape-adjustable but retain their shape by wire tension once adjusted. Such designs are inherently not size-adjustable because the wire is of a preset length. Furthermore, these devices are susceptible to losing their tension over time which makes them unsuitable for long-term display. Some garment hanging solutions are shape-adjustable in three dimensions. This may seem like an appealing feature, but is not ideal for flat hanging garments because it is difficult to set and retain those devices in a perfectly flat orientation. Any non-planar bends in their structure during display will detract from the display's appearance. Many of these shape-adjustable designs also have discontinuities at their adjustment joints. When the garment hangs on these joints, the joints can create visible unevenness and detract from the appearance of the display.

Therefore, there is a need in the art for a device that allows for superior display of garments by wall hanging or suspension. For aesthetic purposes, the device should be designed to keep the garments flat. Furthermore, it should be size and shape adjustable to display a wide variety of garments in an ideal orientation. Despite this adjustability, the device should provide an even support surface for the garments in multiple positions. The device should also be extendable to a large size to accommodate large garments and maximize the displayed area of garments on display. The device should also be durable and capable of retaining its shape for long periods of display. Finally, the display device itself should have a high quality, purpose-built appearance so as to not detract from the garment display as a whole.

SUMMARY OF THE INVENTION

A garment display constructed in accordance with this invention has first and second support arms, each connected to a base and operable to support a portion of a garment. Each support arm has a plurality of links interconnected by link pivot joints. Each link has a disk and a socket. The disk is sized and shaped to pivotally, removably couple to a socket of an adjoining link to form a link pivot joint. Each link pivot joint provides for relative angular movement between adjoined links. Each link has a flange disposed between the socket and the disk of the link for supporting a portion of the garment spanning between the socket of the link and the socket of the adjoining link. Each link has a gap between the flange and the disk; the gap is sized and shaped to receive a free end of the socket of the adjoining link. The flange overlaps the free end of the socket of the adjoining link over a range of the relative angular movement between adjoined links. As a result, each support arm of the garment display provides a smooth and aesthetic support for the garment over a range of positions of the support arm.

A garment display may include a base and first and second support arms. Each support arm is connected to the base and operable to support a portion of a garment. Each support arm has a plurality of links interconnected by link pivot joints. The support arms are movable relative to the base, and movement of the support arms relative to the base is restricted to movement parallel to a common plane. The garment display provides a consistent aesthetic appearance of the garment through a range of motion of the support arms.

A garment display may include a base and first and second support arms. Each support arm is connected to the base and operable to support a portion of a garment. Each support arm has a plurality of links interconnected by link pivot joints. Each link has a longitudinal axis. Each link pivot joint provides for relative angular movement between adjoined links to a first limit position. The first limit position is where longitudinal axes of adjoined links are collinear. The support arms of the garment display can be readily arranged with the links thereof in an aesthetic linear configuration.

A garment display may include a base and first and second support arms. Each support arm is connected to the base and operable to support a portion of a garment. Each support arm has a plurality of links interconnected by link pivot joints. The support arms are movable relative to the base. Each link has a disk and a partially circular socket and has a longitudinal axis passing through a center of curvature of the disk and a center of curvature of the socket. Each link is asymmetric about the longitudinal axis. Each link is operable to be coupled to an adjoining link in an upright orientation and is operable to be coupled to the adjoining link in an inverted orientation by rotating the link about the longitudinal axis 180 degrees relative to the upright orientation.

A method for displaying a garment includes the steps of: (a) assembling a first support arm by joining a plurality of links by link pivot joints which are only capable of movement parallel to a common plane; (b) assembling a second support arm by joining a plurality of links by link pivot joints which are only capable of movement parallel to a common plane; (c) assembling a garment display device by connecting the first support arm and second support arm to a base; (d) supporting a garment on the garment display device; and (e) supporting the garment and garment display device on a support by the base of the garment display device.

DETAILED DESCRIPTION OF THE INVENTION

Figure 1:
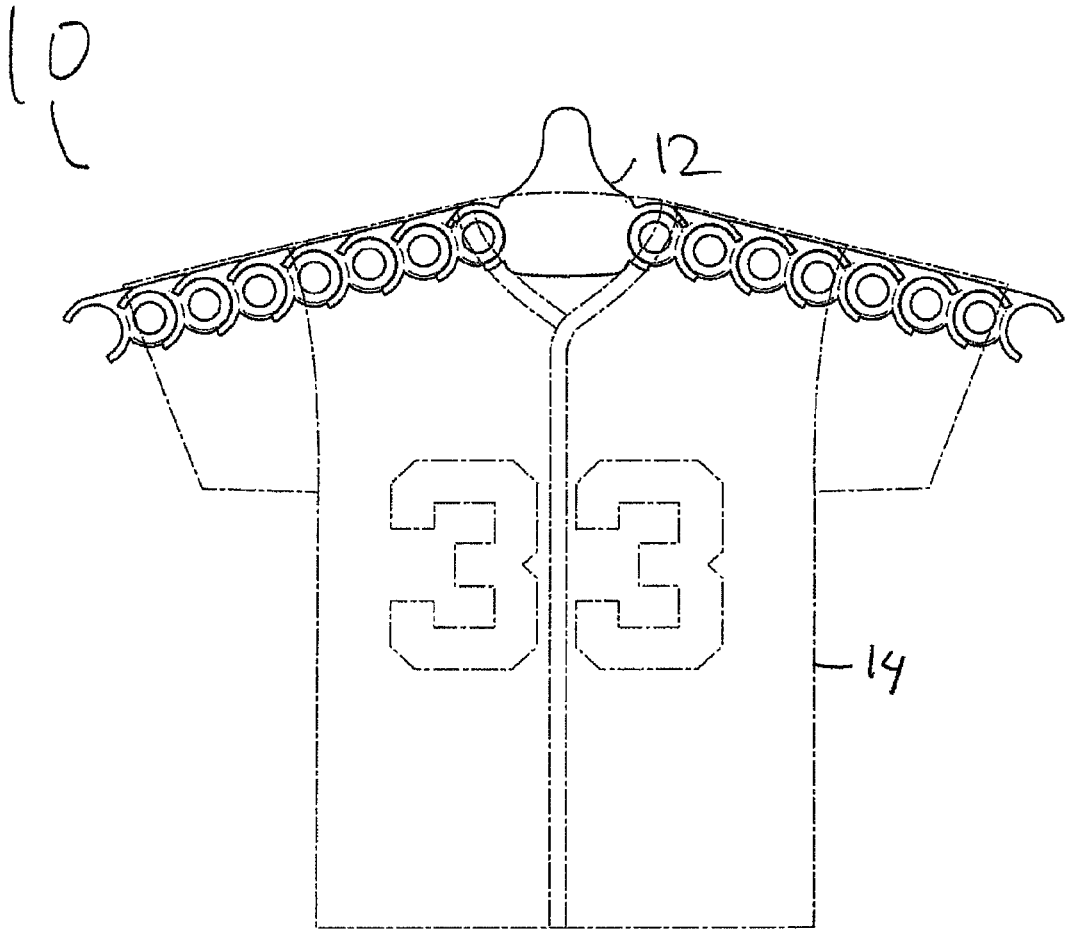
FIG. 1 is a front view of a garment display device constructed in accordance with the invention.

FIG. 1 shows a garment display 10 employing a garment display device 12. The garment display device 12 is for displaying garments 14, such as shirts, coats or athletic jerseys, or other upper-body garments or other garments, in an aesthetically pleasing manner while providing for convenient removal of the garment 14 from the display device 12 in the event that the owner desires to wear the garment 14, or for other purposes. The garment display device 12 also provides for adjustment to accommodate various sizes of garments and for garments 14 having sleeves or no sleeves.

Figure 2:
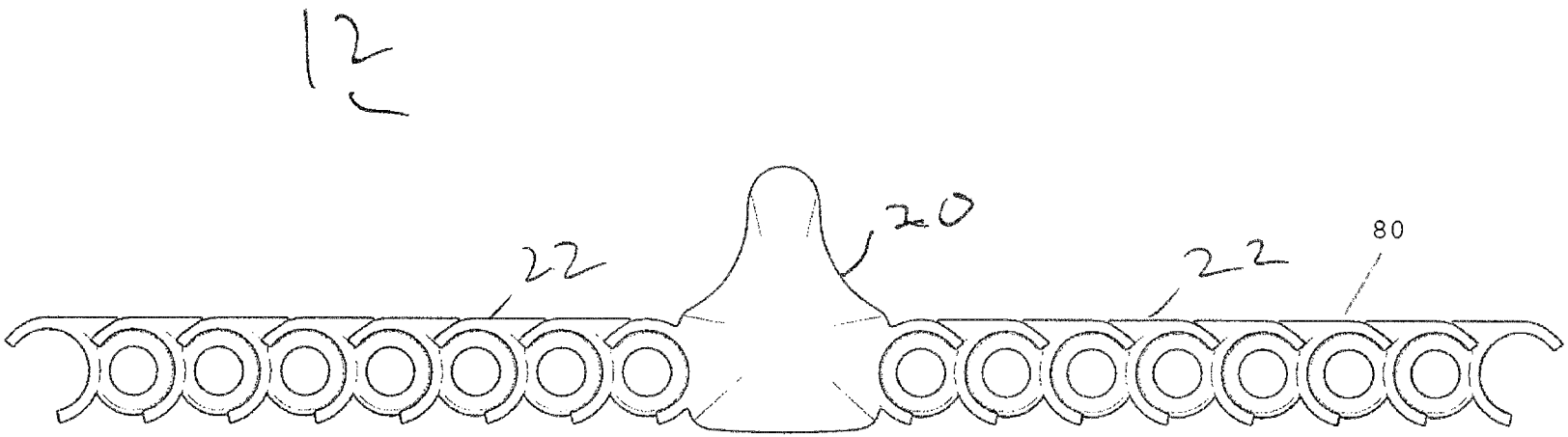
FIG. 2 is a front view of the garment display device of FIG. 1.
Figure 3:
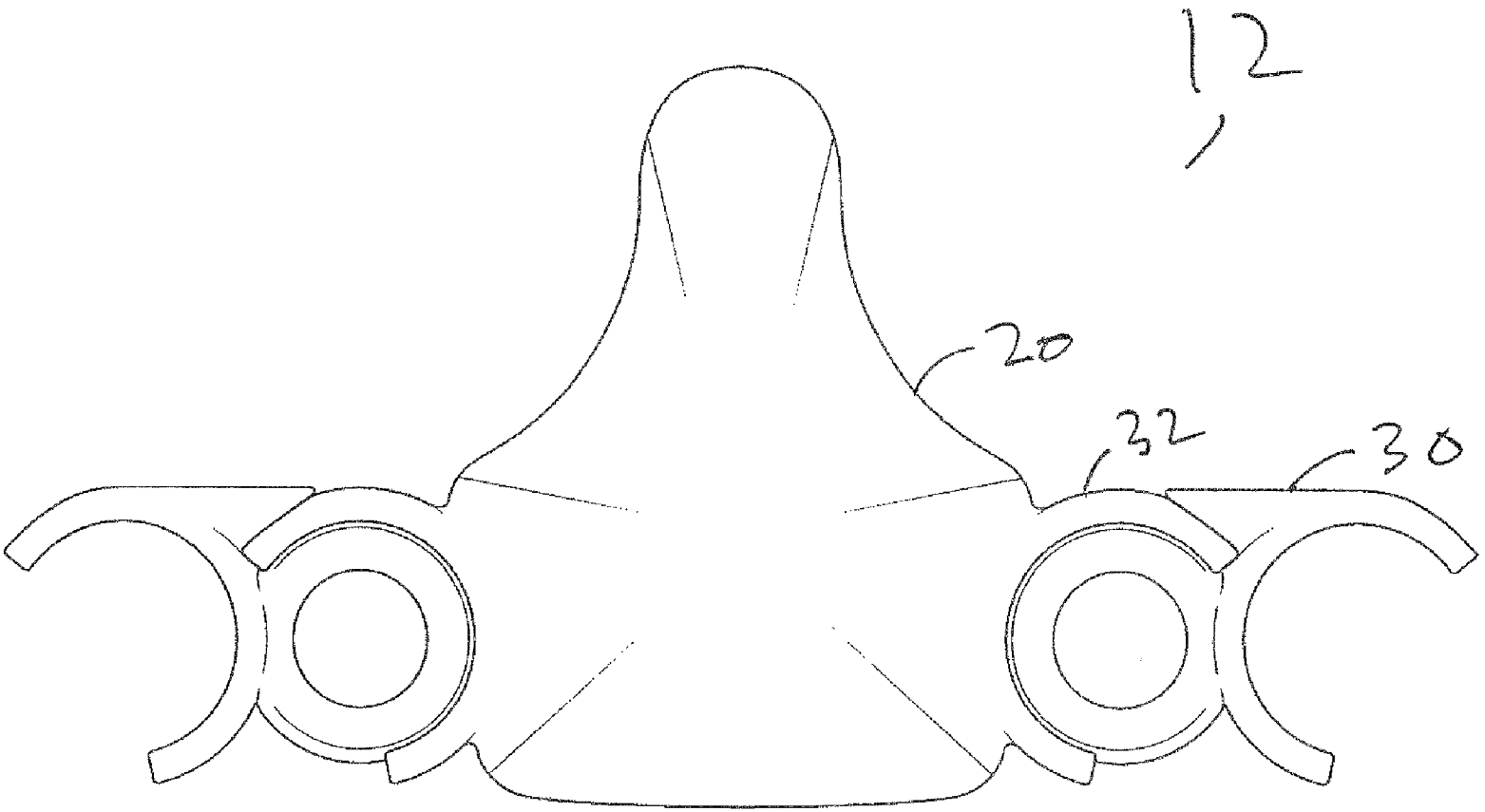
FIG. 3 is a close-up front view of the base and two links of the garment display device of FIG. 1.
Figure 15:
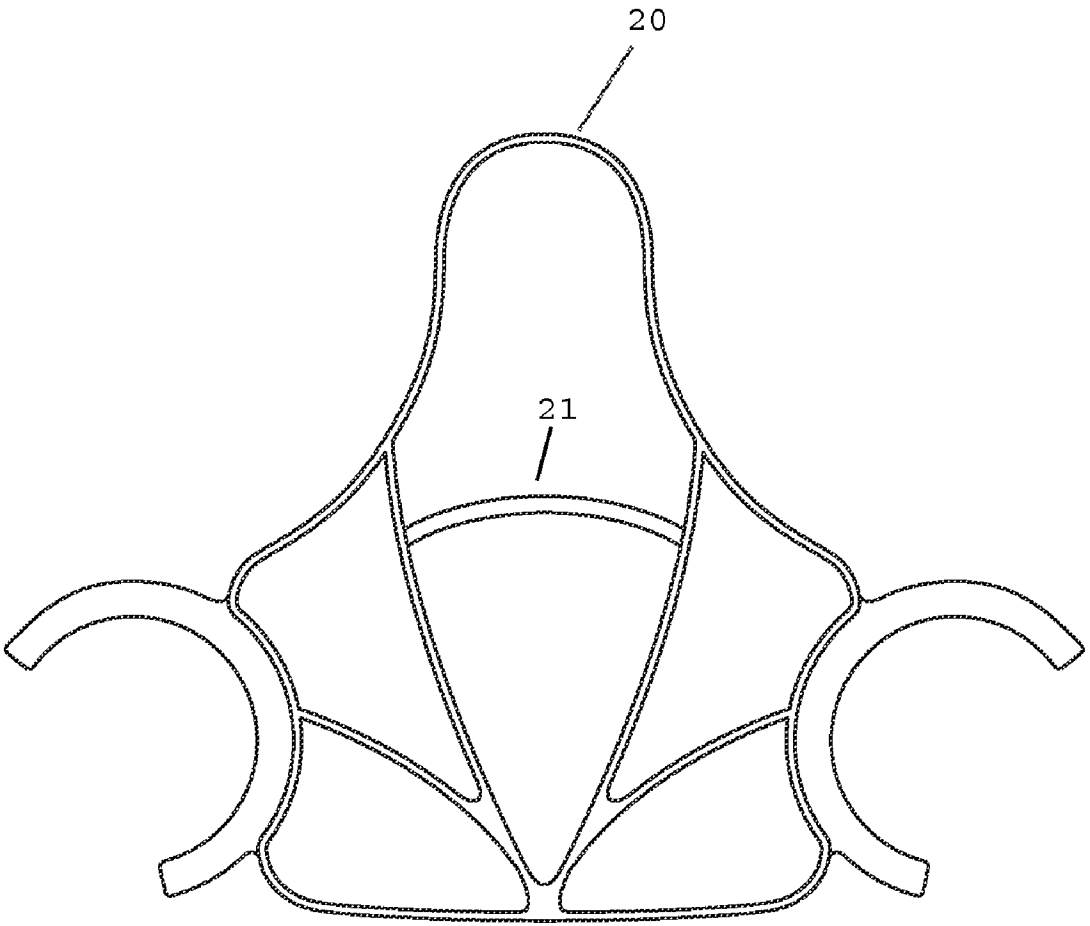
FIG. 15 is a rear elevation view of the base of the garment display device of FIG. 1.

As shown in FIGS. 2, 3 and 15, the garment display 12 has a base 20 and two opposed support arms 22 connected to the base 20. The support arms 22 are operable to support arm portions of a garment 14 and the base portion 20 is for mounting the garment display to a support structure, such as a wall using a hook or other fastener. As depicted in FIG. 15, the base 20 preferably has a mounting bar 21 on the rear of the base 20 for mounting the garment display device on a hook or nail, or the like, affixed to a wall or other support structure.

Each arm 22 is pivotally connected to the base 20 and is comprised of a number of preferably identical and interchangeable links 30 (for example 3-10 links 30 per arm 22). The links 30 of each arm 22 are interconnected by link pivot joints 50 to allow the arms 22 to be adjusted to various configurations. All or some of the portions of the device can be formed of a thermoplastic, such as Acrylonitrile Butadiene Styrene (ABS), or another thermoplastic or another suitable material.

Referring FIG. 2, support arms 22 are linked to base 20 and can be in a fully upward or horizontal position. However, support arms 22 can be pivoted relative to base 20 to match the angle of the shoulders of any particular garment 14. For example, in FIG. 1, support arms 22 are linked to base 20 in at a slightly downward angle to match the contour of the shoulders of the jersey shown in that figure.

Each link 30 has a disk 40 with an outer periphery 60 and has a socket 42 with a channel 62. The outer periphery 60 of the disk 40 and the channel 62 of the socket 42 are each at least partially circular. The disk 40 is sized and shaped to pivotally, removably couple to the socket 42 of an adjoining link 30 to form a link pivot joint 50. Specifically, the disk 40 is received in the channel 62 of the socket 42 of the adjoining link. Preferably, the base portion 20 includes two base sockets 32 on opposed sides of the base 20 and the base sockets 32 have the same configuration as the sockets 42 of the links 30.

The disk 40 of the link 30 is closely received in the socket 42 of an adjoining link 30 and rotational friction between the outer periphery 60 of the disk 40 and the channel 62 of the socket 42 resists pivoting movement of pivot joint 50. The disk 40 and socket 42 are sized and shaped to permit relative movement of links 30 only when sufficient torque is applied to a link 30 and to prevent unintended movement under the weight of a garment 14. Preferably, about 1 to about 4 pound-foot of torque is required to pivot a link 30 relative to an adjoining link 30. The disk 40 and socket 42 are sized and shaped so that the socket 42 applies a small amount of clamping force on the disk 40 thereby creating friction between the channel 62 of the socket 42 and the outer periphery 60 of the disk 40, which prevents unintended movement. In other words, the disk 40 is press fit into the socket 42 to adjoin the links 30. As discussed more fully below in reference to FIG. 14, the socket 42 and disk 40 and socket 42 can have projections 64 and recesses 66 to provide discrete locking positions and enhanced joint resistance between adjoined links. These features allow the arms 22 to be arranged in any one of a variety of configurations while maintaining the configuration while supporting a garment 14.

The socket 42 has two opposed, arcuate segments (46, 48), each in the form of a segment of a circle. Each segment 46, 48 has a free end. The channel 62 of the socket 42 is generally C-shaped and defines an arc $\Theta_1$ (See FIG. 4) of greater than 180 arcdegrees, preferably between 180 arcdegrees and 270 arcdegrees, most preferably about 222 arcdegrees. Preferably, each socket 42 is composed of a flexible material and is capable of resiliently deforming/expanding to accept the disk 40 through the socket opening 54 and then contract to confine and secure the disk 40 once it has passed through the socket opening 54.

The outer periphery 60 of the disk 40 defines an arc $\Theta_2$ (See FIG. 4) of greater than 180 arcdegrees and preferably greater than 270 arcdegrees. The arc defined by the outer periphery 60 of the disk 40 is greater than the arc defined by the channel 62 of the socket 42 such that the disk 40 can rotate through a range of positions within the socket 42. Preferably, the disk 40 can rotate through a range of about 64 arcdegrees with respect to an adjoined socket 42.

Figure 6:
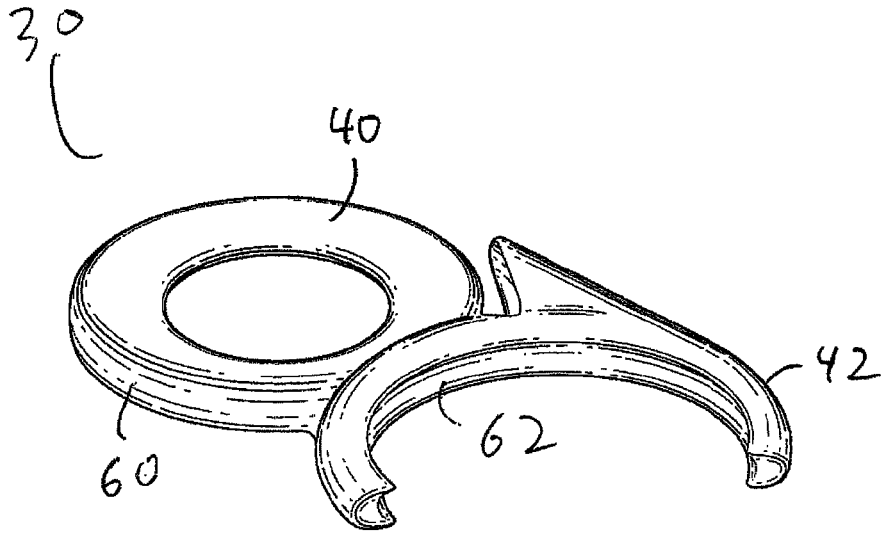
FIG. 6 is an angled perspective view of a link from the garment display device of FIG. 1.
Figure 7:
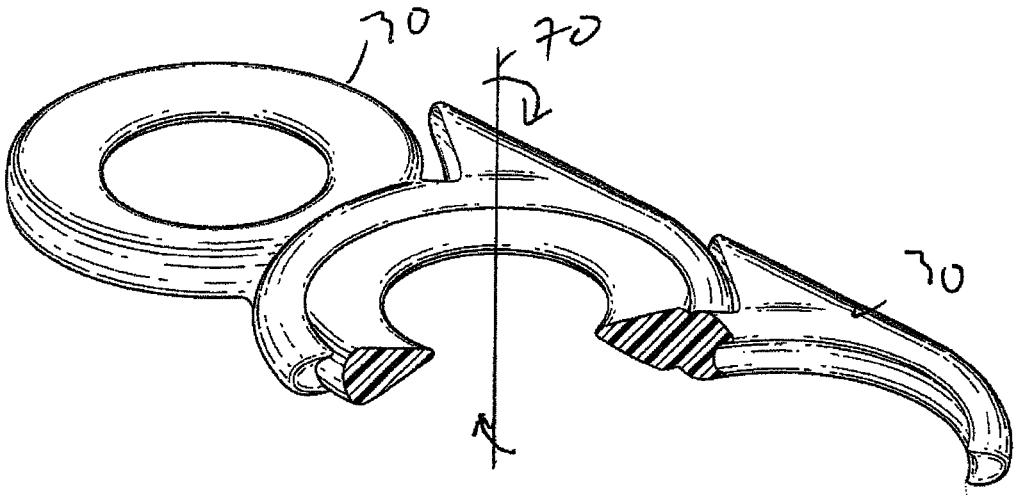
FIG. 7 is an angled perspective partially cross-sectioned view of two links from the garment display device of FIG. 1 linked together.

The channel 62 has a concave inner surface (on a cross section) and the outer periphery 60 of the disk 40 has a convex surface (on a cross section), complementary to the concave inner surface of the channel 62. As depicted in FIGS. 6 and 7, the concave cross sectional contours of the socket define spaced apart side walls which embrace and laterally confine a disk engaged in the socket.

A maximal inside diameter of the socket $D_1$ (See FIG. 4), as measured through a center of curvature of the at least partially circular channel 62, is slightly less than a maximal outside diameter the disk $D_2$, as measured through a center of curvature of the at least partially circular outer periphery 60 of the disk 40. A radius of the outer periphery 60 is one-half the diameter $D_2$. Interference between the socket 42 and the disk 40 and creates the rotational friction between adjoining links 30. Preferably, the inside diameter of the socket 42 is about 58.0 mm and the outside diameter of the disk 40 is about 58.1 mm.

A radius of curvature of the concave inner surface of the channel 62 is substantially less than the inside diameter $D_1$ of the socket 42.

Each link 30 has a generally flat shape and a center plane passes through a center of the link 30. Each link 30 is preferably symmetric across (i.e., on either side of) the center plane.

A longitudinal axis L of the link lies on the center plane of the link and passes through the center of curvature 72 of the disk 40 and the center of curvature 74 of the channel 62. The disk 40 is preferably symmetric about the longitudinal axis, but the socket 42 is preferably asymmetric about the longitudinal axis.

Figure 5:
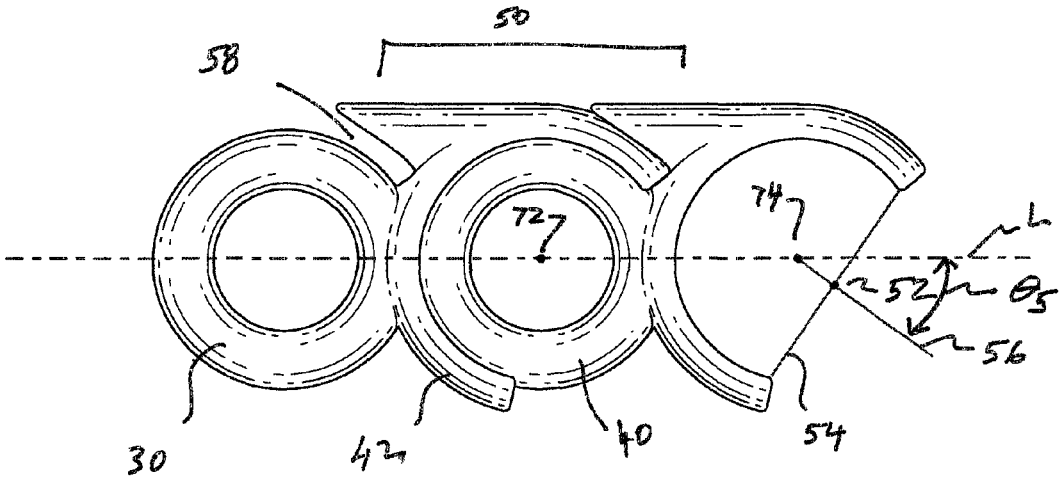
FIG. 5 is a close-up front view of two links from the garment display device of FIG. 1 linked together.

The socket 42 has an opening 54 between the free ends of the opposed segments (46, 48) of the socket 42. A center 52 of the opening 54 of the socket 42 lies on a midpoint between the free ends of the opposed segments of the socket 42. The center 54 of the opening 52 is angularly offset from the longitudinal axis L of the link by $\Theta_5$ (about 20 to about 60 arcdegrees, and preferably about 30 arcdegrees), as measured from the longitudinal axis, clockwise (in FIG. 5) about the center of curvature 74 of the channel 62 of the socket 42.

The angular offset of the opening 54 of the socket 42 forms a long segment 48 of the socket 42 and a short segment 46. The long segment 48 of the socket 42 preferably defines an arc $\Theta_3$ (See FIG. 4) of about 140 arcdegrees, as measured in a first direction (e.g., clockwise in FIG. 4) about the center of curvature 74 of the channel 62, from a point on the longitudinal axis between the centers of curvature 72, 74 of the disk and the socket. The short segment 46 preferably defines an arc $\Theta_4$ of about 85 arcdegrees, as measured from the same point in an opposite direction (e.g., counterclockwise).

The opening 54 of the socket 42 has a width (the distance between the free ends) that is less than the outside diameter of the disk $D_2$. The disk 40 is coupled to the socket 42 of an adjacent link 30 by pushing the links 30 together along an opening axis 56 passing in a radial direction through the center 52 of the opening 54 of the socket 42 and the center of curvature 74 of the channel, to urge the disk 40 through the opening 54 of the socket 42. The opening 54 of the socket 42 expands to receive the disk 40, by resilient flexure of the opposed segments (46, 48) of the socket 42. After insertion of the disk 40, the opening 54 of the socket 42 contracts to its original dimension. Preferably, the width of the opening 54 of the channel 62 is about 50 mm.

The disk 40 can be removed (de-coupled) from the socket 42 by pulling the links 30 apart in opposite directions along the opening axis 56, to remove the disk 40 from the socket 42. Again, the socket 42 expands to allow the disk 40 to pass through the socket opening 54 and, after removal of the disk 40, the socket 42 contracts to its original dimension.

Preferably, movement of each support arm 22 relative to the base 20 is restricted to movement parallel to a common plane (for example a vertical plane) so that the support arms 22 provide a consistent aesthetic appearance throughout a range of motion of the arms 22. The center plane of each link is preferably parallel to (which includes being coplanar with) the common plane when the arms 22 are connected to the base 20. Further, when the garment display device 12 is mounted to a vertical support wall, the movement of the arms 22 is preferably restricted to being substantially flush with and parallel to the support wall.

When a disk 40 of a link 30 is coupled to a socket 42 of an adjoining link 30, the socket 42 confines the disk 40 and prevents movement of the disk 40 relative to the socket 42 in all respects (when properly coupled) except pivoting movement about an axis of rotation 70 passing through both the center of curvature 74 of the channel 62 and the center of curvature 72 of the adjoined disk 40 (which are aligned). Preferably, this axis of rotation 70 is perpendicular to the common plane of movement of the arms 22. For example, if the common plane is vertical (e.g., parallel to a supporting wall), then the axis of rotation 70 would be horizontal (e.g., perpendicular to the supporting wall). Also, the axis of rotation of all link pivot joints 50 of an arm 22 (or of both arms 22) are preferably parallel (e.g., are all horizontal) such that movement of the support arms 22 is restricted to being parallel to the common plane.

Each support arm 22 of the garment display 12 has an upwardly-facing upper support surface 80 which forms a smooth support surface for the associated arm portion of garment 14. Preferably, the upper support surface 80 lacks any substantial scalloped profile (such as large peaks/valleys) which can cause an undulating appearance in the garment 14, which may be undesirable. Instead, each arm 22 provides a smooth support surface for the garment 14 over a range of positions and configurations of the arms 22.

Each link preferably includes a flange 44 for creating a smooth support surface between adjacent links 30 through a range of relative positions between links 30. The flange 44 supports a portion of a garment 14 that spans between the socket 42 of one link and the socket 42 of the adjoining link 30. The flange 44 is preferably connected to the socket 42 (or more precisely, to the long segment 48 of the channel 62 thereof) and is disposed between the channel 42 and the disk 40. A gap 58 is formed between the flange 44 and the disk 40 which is preferably sized and shaped to closely receive a free end of a segment (46, 48) of the socket 42 of the adjoining link 30. The flange 44 overlaps the free end of the segment of the socket 42 of the adjoining link 30 over a range of angular positions between adjoined links 30 of up to at least about 58.5 degrees so as to provide smooth support for the garment 14 over a range of positions.

The flange 44 has a linear (i.e., straight), upwardly-facing supporting surface 45 which supports the portion of the garment 14 that spans between adjoined links. The supporting surface 45 of the flange 44 is fixed parallel to the longitudinal axis L of the link and is aligned tangent to the socket 42. Preferably, the supporting surface 45 is spaced from the longitudinal axis a distance greater than a radius of the outer periphery 60 of the disk 40 (that is, greater than one-half of diameter $D_2$) and equal to (or substantially equal to) an outer radius of the socket 42. Further, the supporting surface 45 is preferably aligned tangent to the long segment 48 of the channel 62 of the socket 42 of the link. The supporting surface 45 is also tangent to the socket 42 of the adjoining link over a range of angular positions between adjoined links. The center plane of the link preferably passes through the supporting surface 45. The flange and socket of consecutive links provide for a smooth garment support across the full length of the support arm while accommodating adjustment of the configuration and position of the support arms.

Figure 4:
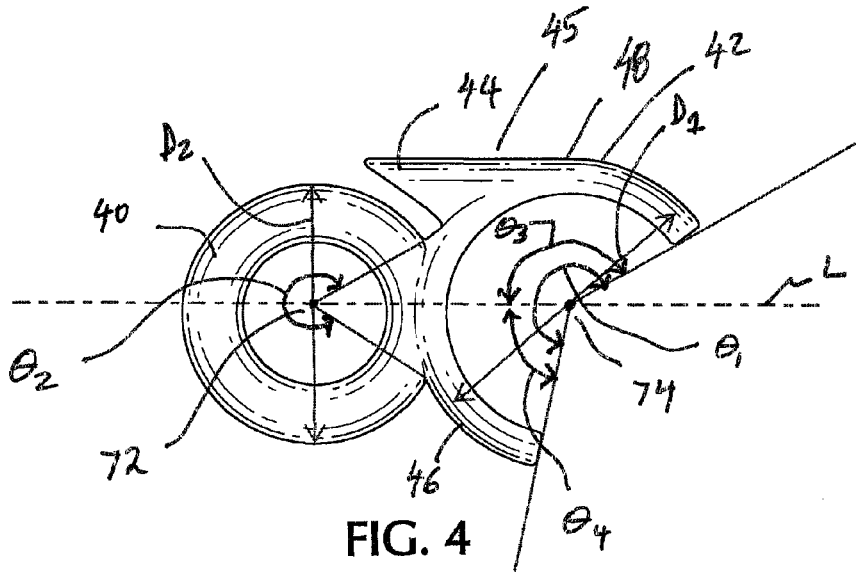
FIG. 4 is a close-up front view of a link from the garment display device of FIG. 1.

As depicted in FIG. 4, the distance between the centers of curvature 72, 74 respectively of the disk 40 and socket 42 is less than the sum of the outside radii of the disk and socket. The arrangement is such that the circular forms of the disk and socket intersect in the region of the longitudinal axis L. This provides for a particularly compact link structure and minimizes the length of the flange 44 required to bridge between adjacent links.

Preferably, when a series of links 30 are arranged with their longitudinal axes aligned (i.e., collinear, as in FIGS. 1 & 2), the flanges 44 of the links form a substantially flat support surface 80 spanning across the series of links for supporting the garment 14 in an aesthetically pleasing manner.

Figure 8:
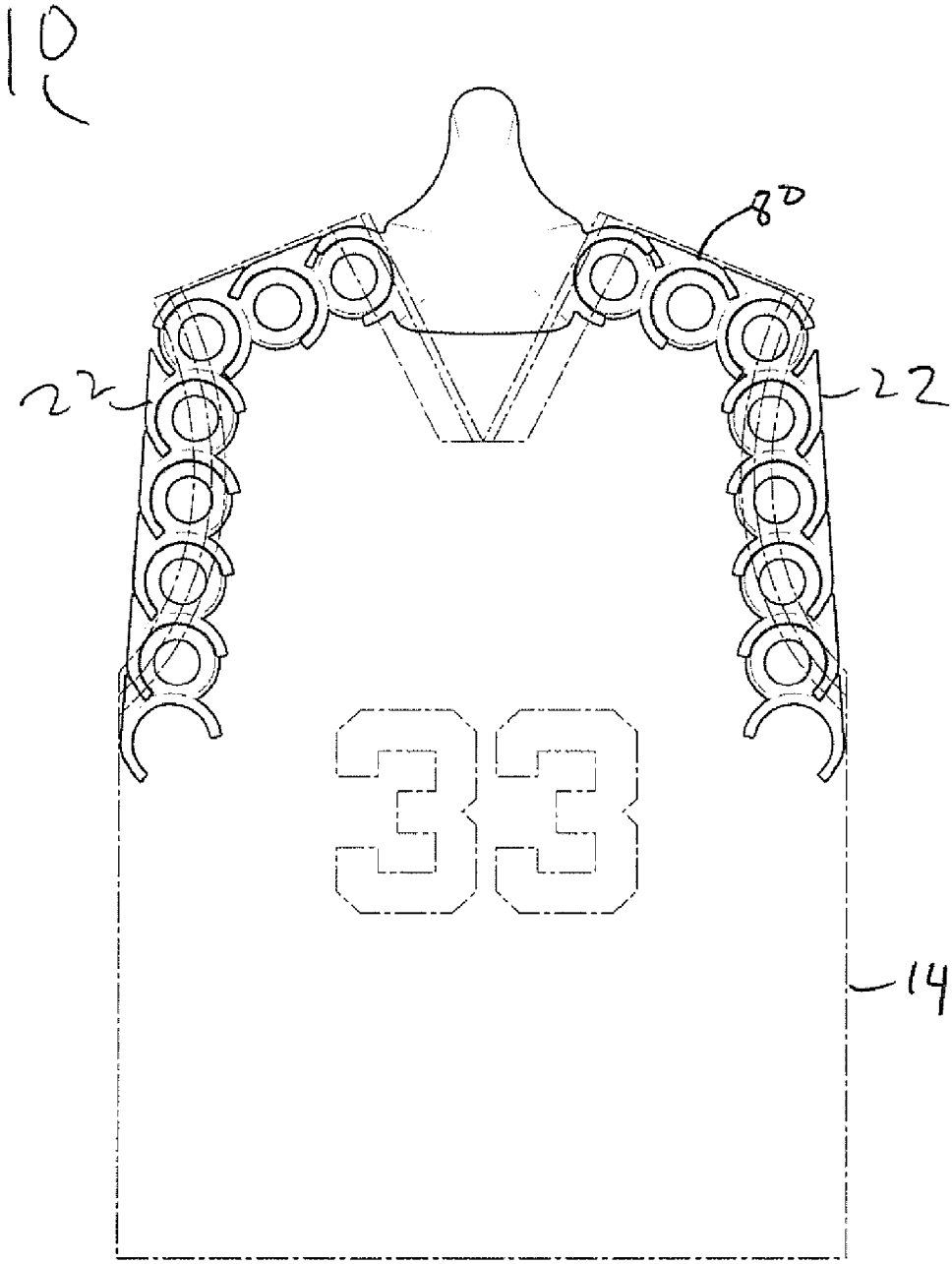
FIG. 8 is a front view of a sleeveless garment supported by the garment display device of FIG. 1, showing each support arm in a bent configuration.

Referring to FIG. 8, for garments 14 having no sleeves (i.e. sleeveless garments), the proximal portion of each support arm 22 may be directed outwardly from the base 20 to support the shoulder portions of the garment 14 and the distal portions of the arms 22 of the garment display 12 may be directed downwardly to contact and support the garment 14 below the arm opening. This is an effective way to display a sleeveless garment 14; however the arm portions 22 maybe visible in the arm opening of the garment 14, which may be undesirable.

Figure 9:
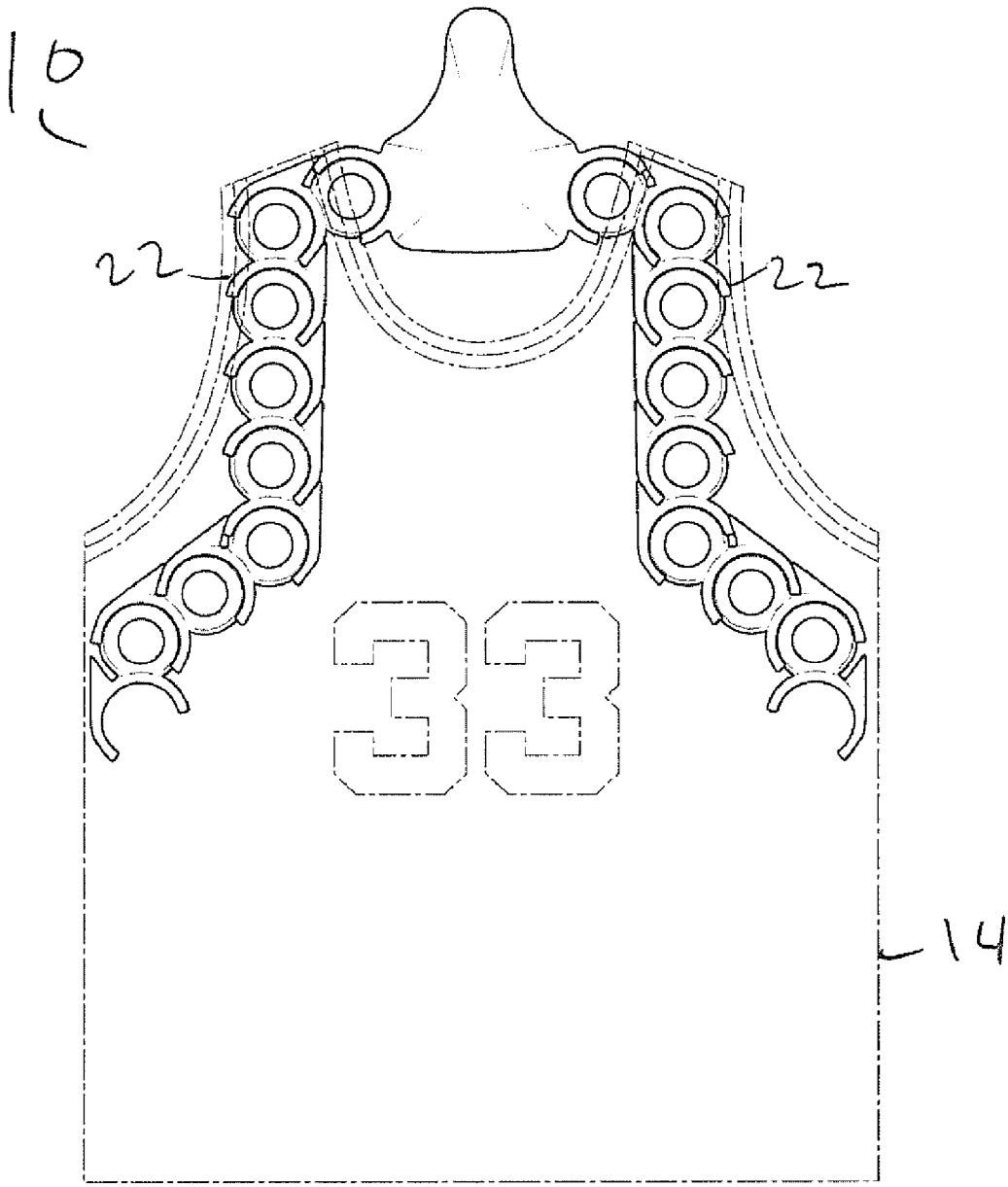
FIG. 9 is a front view of a sleeveless garment supported by the garment display device of FIG. 1, showing each support arm in a reversed-link and bent configuration.
Figure 10:
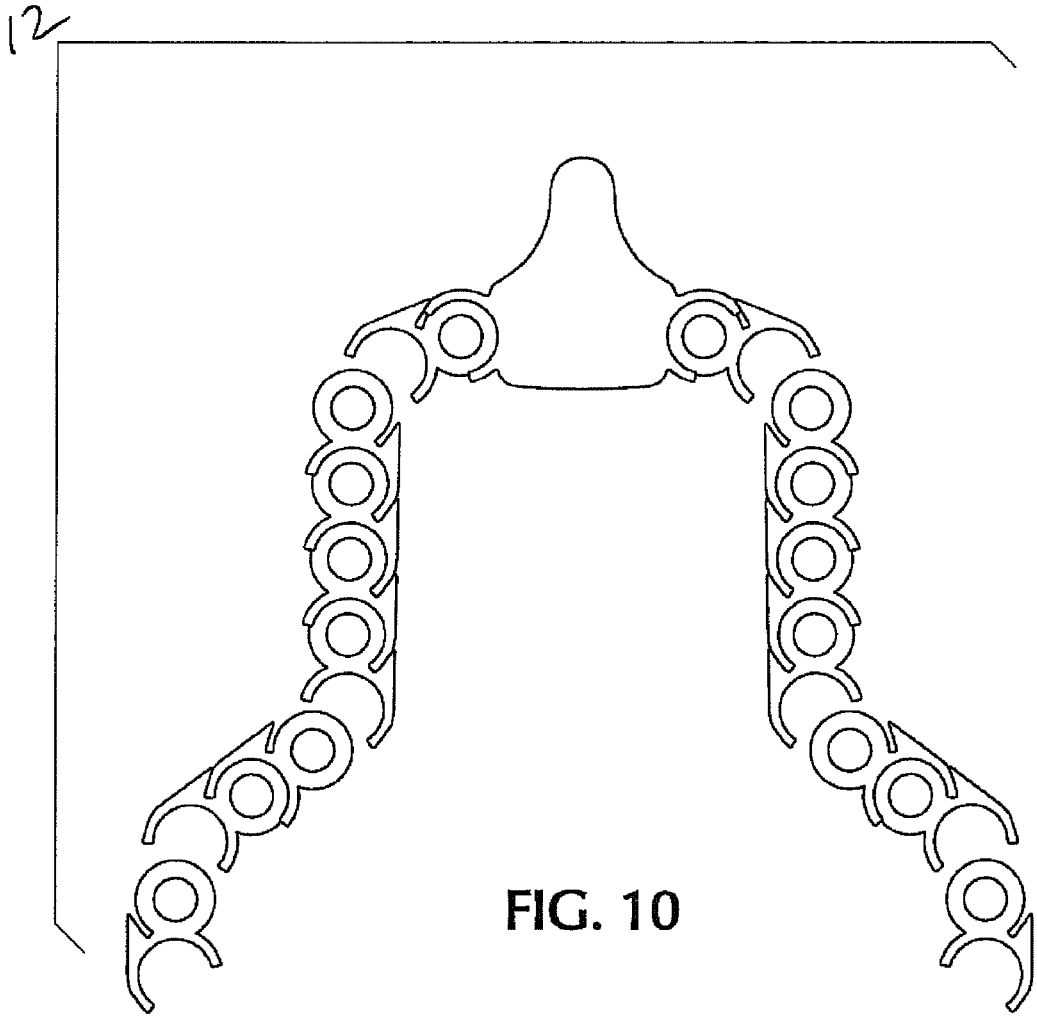
FIG. 10 is a front disassembled view of the garment display device of FIG. 1, configured as shown in FIG. 9.

Referring to FIG. 9, to conceal the arm portions 22 of the garment display 12 within a sleeveless garment 14, the arms 22 can be configured in a manner such that the arms 22 are not visible through the arm openings of the garment 14. In particular, a proximal portion of the arm 22 is directed outward to support the shoulder portion (perhaps only one link); a middle portion of the arm 22 is directed downward within the garment 14 and a distal portion of the arm 22 is directed outwardly (and perhaps downwardly again) to contact and support the garment 14 below the arm opening. This complex arm configuration is accomplished by placing at least some of the links 30 of the arm 22 in an "inverted" orientation.

A link 30 can be coupled to an adjoining link 30 in an "upright" orientation or the link 30 can be coupled to an adjoining link 30 in an "inverted" orientation. In the "upright" orientation (depicted in FIG. 1) the long segment 48 of the socket 42 and the flange 44 of the link 30 are above the longitudinal axis of the link 30. This is the manner in which the all links 30 would typically be coupled to support a garment 14 having sleeves. In the "inverted" orientation (depicted in FIG. 9), the long segment 48 of the socket 42 and the flange 44 of the link 30 are below the longitudinal axis of the link 30. This is the manner in which some of the links 30 (but usually not all) would typically be coupled to support a garment 14 with no sleeves, so as to permit the arms 22 to be configured in an S-shape or other complex/compound curve shape to conceal the presence of the support arms 22 within a sleeveless garment 14. The orientation of a link can be changed from the "upright orientation" to the "inverted orientation" (or vice versa) by decoupling the link from the adjoining link and then rotating the link one-half turn (i.e., 180 degrees) about its longitudinal axis.

In the configuration depicted in FIG. 9, each arm 22 has eight links 30 with the first, sixth, seventh and eighth links 30 being in the "upright" orientation, and the second through fifth links 30 being in the "inverted" orientation. In this manner, the garment display device 12 can display sleeveless garments 14 in an effective and aesthetically pleasing way.

The link pivot joint 50 formed by adjoined links has a first limit position wherein the longitudinal axes of the adjoined links 30 are collinear which permits a chain of several links 30 to be readily and conveniently arranged in an aesthetically pleasing straight (collinear) configuration. The socket 42 portion of one of the adjoined links 30 forms a stop which contacts the free end of a segment (46, 48) of the socket 42 of the other link 30 when the link pivot 50 formed by the adjoined links 30 is in the first limit position. The stop is located at the base of the gap 58 formed between the flange 44 and the disk 40 of the link 30. When two links 30 are joined in the "upright" orientation, the free end of the long segment 48 of the socket 42 of one of the links will contact the stop of the other link when the links are arranged in the straight configuration.

Figure 11:
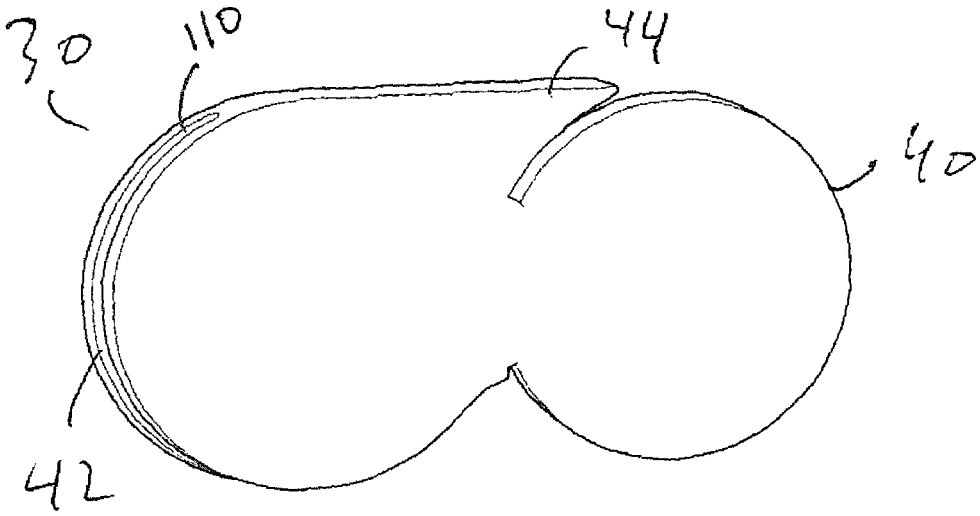
FIG. 11 is a perspective view from the front of a link for a second embodiment of a garment display device.
Figure 13:
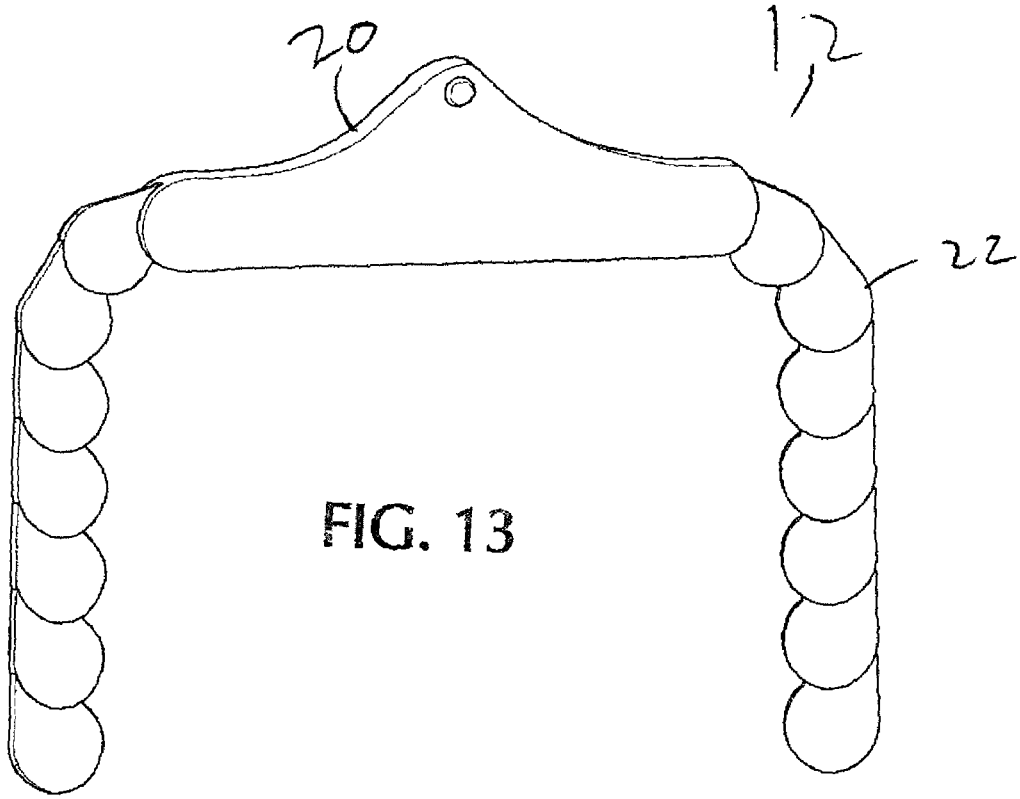
FIG. 13 is a front view of the garment display device of FIG. 12, showing the support arms in a bent configuration.
Figure 12:
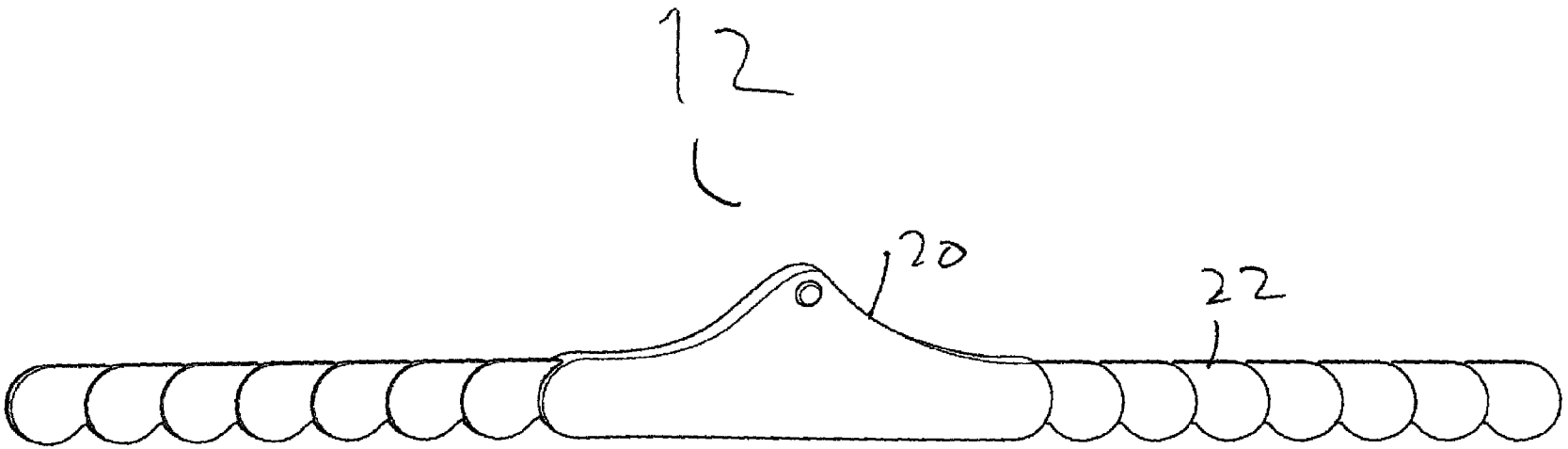
FIG. 12 is a front view of the second embodiment of the garment display device using links from FIG. 11.

Referring to FIGS. 11-13, in an alternative embodiment, the socket 42 of the link 30 can substantially surround the disk 40 of an adjoining link 30. The disk 40 is received in a slot 110 formed in the link 30 and the disk 40 is substantially (or entirely) enclosed/covered by the socket 42. The channel is disposed and concealed within the link. In this embodiment (and/or other embodiments disclosed herein) the socket 42 can engage lateral sides of the disk 40 in addition to or instead of the periphery of the disk 40 to provide friction or other resistance to relative rotational movement of adjoined links 30. In other respects, the links 30 of this embodiment can be the same as and function similar to the links of the other embodiments disclosed herein.

Using the devices described herein, an individual can perform a novel method for displaying a garment 14. The user assembles a first support arm 22 by joining a plurality of the links 30 by the link pivot joints 50. The user also assembles a second support arm 22 by joining a plurality of the links 30 by the link pivot joints 50. The user then assembles a garment display device 12 by connecting the first support arm 22 and second support arm 22 to a base 20. Next, the user inserts the garment display 12 into a garment 14 and adjusts the support arms 22 to the desired positions. As depicted, if the garment 14 is an upper-body garment such as a shirt or sports jersey, or another upper-body garment, the bracket 20 is located in a neck opening of the garment and the support arms are located in the sleeve portions of the garment. Finally, the user supports the garment 14 and garment display 12 on a support, by the base 20 of the garment display 12.

A user can further perform other steps when using the devices described herein. For example, the user can adjust the shapes of the first and second support arms 22 within a common plane to support the garment 14 in a desired shape or posture. A user can also adjust the length of one or both of the support arms 22 by altering the number of links 30 used to assemble that support arm 22. This allows a user to match the size of the garment display 12 to the size of the garment 14 desired to be displayed.

A user can also employ methods of garment displaying that involve using reversed links 30 on the support arms 22. The links 30 are capable of assuming a first or a second orientation within the common plane. This is because they can only pivot about the common plane and are therefore restricted to an "upright" or "inverted" position within that plane. Given the nature of the links 30, a user can either assemble the support arms 22 such that they contain all of the links in an "upright" orientation, or such that they contain some links in an "upright" and some in an "inverted" orientation. This capability allows a user to further tailor the garment display device 12 to the garment 14 to create a desired appearance once hung.

In addition, the garment display device 12 allows a user to easily and conveniently remove the garment 14 from the garment display 10 to allow the user to wear the garment, if desired, or for some other use.

Figure 14:
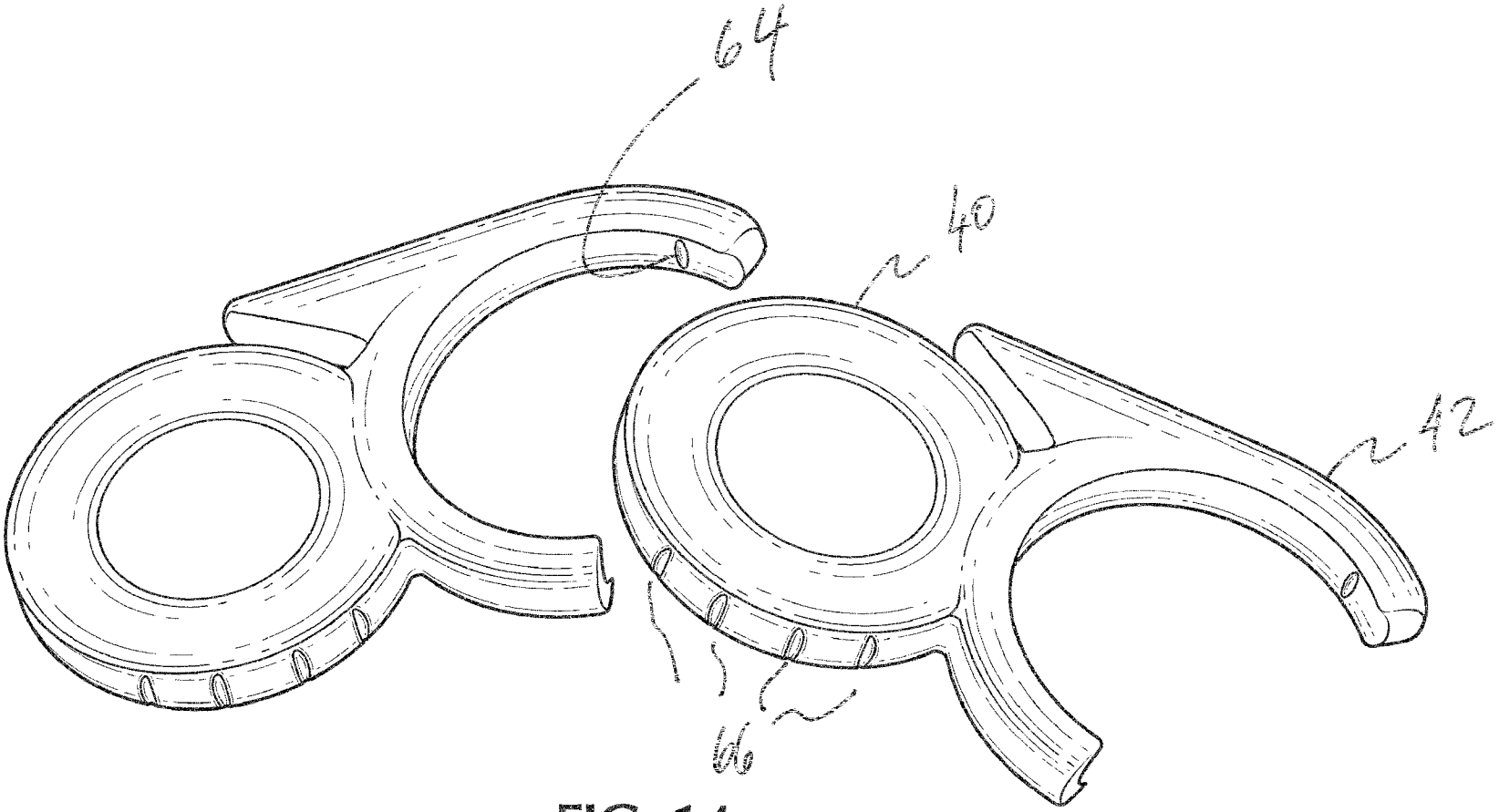
FIG. 14 is a perspective view of two links of the display device showing projections and recesses in the channel and disk.

Referring to FIG. 14, alternatively or additionally, the socket 42 (or the disk 40) can have one or more projections 64 and the disk 40 (or socket 42) can have a plurality of spaced recesses 66 which receive the projections 64 of an adjoining link 30 to provide discrete locking positions of adjoined links 30. When socket 42 applies clamping force onto disk 40, it tends to secure each projection 64 into one of the recesses 66 because this is the lowest energy state of socket 42. It takes additional force to dislodge the projections from the recesses and adjust the bend angle of pivot joint 50. For example, when the pivot joint is aligned with the projections 64 in recesses 66, the torque required to adjust the links can be about 4 pound-foot, whereas when then the projections 64 are not in recesses 66, the required torque can be about 1 pound-foot of torque. Thus, the pivot joint 50 will have stronger holding pressure in several distinct positions. However, the pivot joint is adjustable to, and will hold its position in, any position within a range of positions, even if each projection is not within a recess. The base sockets 32 can also have projections 64 or recesses 66, similar to the sockets 42 of the links.

Preferably, the disk 40 has a first set of recesses 66 (for example four) on the bottom of the disk 40 and a second set of recesses (not shown) on the top of the disk (not shown). Further, the socket 42 preferably has a first projection 66 within the channel 62 adjacent the free end of the long segment 48 thereof and has a second projection (not shown) within the channel 62 adjacent the free end of the short segment 46 thereof.

Although the invention has been described with reference to embodiments herein, those embodiments do not limit the scope of the invention. Modifications to those embodiments or different embodiments may fall within the scope of the invention.

What is claimed is:

1. A garment display, comprising:

a base; including an element for hanging the base on a support, first and second garment support arms connected to opposite sides of the base and being operable to support a portion of a garment, each support arm having a proximal end connected to the base by a base pivot joint, each support arm having a plurality of links interconnected by link pivot joints for pivoting movement in a common plane;

each link having a disk with an outer periphery and a socket with a channel, the outer periphery of the disk and the channel of the socket each being at least partially circular;

the socket of each link comprising upper and lower arcuate segments defining an opening smaller than a diameter of the disk for the resilient press fit reception, in a radially inward direction, of a disk of an adjacent link to form a pivot joint of adjacent links;

each link having a longitudinal axis passing through a center of curvature of the outer periphery of the disk and through a center of curvature of the channel of the socket;

each link being operable to be coupled to an adjoining link in an upright orientation and being operable to be coupled to the adjoining link in an inverted orientation, by rotating the link about the longitudinal axis 180 degrees relative to the upright orientation;

each link pivot joint providing for relative angular movement between adjoined links;

each link having a flange disposed on an upper side thereof and extending from the upper arcuate segment of the socket toward and into overlapping relation to an upper portion of the disk thereof, the flange having an upwardly facing linear external surface for supporting a portion of the garment spanning between the socket of the link and the socket of the adjoining link;

the linear external surface of the flange being parallel to the longitudinal axis of the link and being spaced from the longitudinal axis a distance greater than a radius of the outer periphery of the disk, each socket being asymmetric about the longitudinal axis, with said upper arcuate segment extending over a first arcuate angle, as measured from the longitudinal axis, of greater than 90° and the lower arcuate segment extending over a second arcuate angle, as measured from the longitudinal axis, of less than 90°, and the lower arcuate segment of said socket having an arcuate external surface to accommodate overlapping thereof by a flange of an adjoining link coupled in an inverted orientation.

2. A garment display, as in claim 1, wherein:

each link has an arcuate gap between the flange and the disk, the gap being sized and shaped to receive a free end of the socket of the adjoining link; and the flange overlaps the free end of the socket of the adjoining link over a range of the relative angular movement between adjoined links.

3. A garment display as in claim 1, wherein:

each base pivot joint comprises a socket of the same configuration as the sockets of the links including upper and lower arcuate segments forming an opening for the resilient press fit reception of a disk at the proximal end of a support arm to permit rotational adjustment of the associated support arm relative to the base about only one axis, perpendicular to the common plane.

4. A garment display as in claim 1, wherein:

the link pivot joints provide discrete locking positions of adjoined links and maintain the adjoined links in a consistent position relative to each other while the garment display is supporting a garment.

5. A garment display as in claim 4, wherein:

the channel of each link has at least one radially inward projection; and the outer periphery of the disk of each link has a plurality of recesses sized and shaped to receive the projection of the channel of an adjoining link, the recesses being spaced around the periphery of the disk.

6. A garment display as in claim 1, wherein:

each socket comprises a slot;

each disk is sized and shaped to be inserted in the slot to form a link pivot joint; and each socket substantially surrounds a disk when it is inserted into the slot to form a link pivot joint.

7. A garment display according to claim 1, wherein:

each link pivot joint provides for relative angular movement between adjoined links between first and second limit positions; and the first limit position being wherein longitudinal axes of adjoined links form a substantially straight line and the linear external surfaces of the flanges of adjacent links joined in the same orientation are substantially aligned;

whereby the support arms of the garment display can be readily arranged with the links thereof in an aesthetic linear configuration.

8. A garment display according to claim 1, wherein:

said first arcuate angle is about 140° and the second arcuate angle is about 85°.

9. A garment display according to claim 1, wherein:

the disk and socket are of generally circular external configurations, and the distance between the center of curvature of the socket and the center of curvature of the disk is less than the sum of external radii of the of the socket and disk, such that the generally circular configurations of the disk and socket of each link intersect in the region of the longitudinal axis.

10. A garment display according to claim 3, wherein:

the socket of each base pivot joint comprises upper and lower arcuate segments, and the upper arcuate segment of each base pivot joint extends laterally outward a distance greater than the lower segment to form a downwardly angled socket opening for the reception of a disk at the proximal end of a support arm.

11. A garment display according to claim 1, wherein:

the disk of each link is formed with a peripheral configuration of convex cross sectional shape, and the socket of each disk formed with an internal channel of concave cross sectional shape complimentary to the convex cross sectional shape of the disk and forming spaced apart sidewalls, whereby when a disk is engaged in a socket of an adjacent link the disk is laterally confined by the spaced side walls of said socket.

* * * * *